US006328951B1

(12) United States Patent
White et al.

(10) Patent No.: US 6,328,951 B1
(45) Date of Patent: Dec. 11, 2001

(54) WATER-SOLUBLE SOLID-PHASE IRONING AID FRESHENING COMPOSITION TABLETS CONSISTING OF SAME FOR USE IN THE STEAM CHAMBER OF AN IRON AND PROCESS FOR PREPARING AND UTILIZING THE SAME

(75) Inventors: Michael John Robert White; Andrew John Crossman, both of Amsterdam (NL); David Neil Ellison, London (GB)

(73) Assignee: International Flavors & Fragrances Inc., New York, NY (US)

( * ) Notice: Subject to any disclaimer, the term of this patent is extended or adjusted under 35 U.S.C. 154(b) by 0 days.

(21) Appl. No.: 09/468,869

(22) Filed: Dec. 21, 1999

(51) Int. Cl.[7] ..... A61L 9/00; A61L 9/01; A61K 7/46; B05D 3/12; B05D 3/02

(52) U.S. Cl. ..... 424/76.1; 510/513; 512/1; 512/4; 427/370; 427/387; 427/389.9; 427/381

(58) Field of Search ..... 424/464, 486, 424/76.1; 514/63, 453, 718, 730; 510/108, 197, 276, 281, 445, 513; 252/8.91; 512/1, 4

(56) References Cited

U.S. PATENT DOCUMENTS

| | | | | |
|---|---|---|---|---|
| 4,099,912 | * | 7/1978 | Ehrlich | 8/137 |
| 4,196,851 | * | 4/1980 | Davis | 239/54 |
| 4,219,436 | * | 8/1980 | Gromer et al. | 510/224 |
| 4,552,777 | | 11/1985 | Dente et al. | 252/8.91 |
| 4,663,068 | * | 5/1987 | Hagemann et al. | 510/102 |
| 5,040,264 | * | 8/1991 | Bryant | 15/339 |
| 5,062,971 | | 11/1991 | Coffindaffer et al. | 252/8.91 |
| 5,064,543 | | 11/1991 | Coffindaffer et al. | 252/8.91 |
| 5,409,619 | | 4/1995 | DeRenzo | 252/8.91 |
| 5,695,677 | * | 12/1997 | Silvester et al. | 252/8.91 |
| 5,904,028 | | 5/1999 | Fujiura et al. | 53/431 |
| 5,928,631 | * | 7/1999 | Lucas et al. | 424/65 |
| 5,997,851 | * | 12/1999 | Cox et al. | 424/70.1 |
| 5,998,346 | * | 12/1999 | Welch et al. | 510/230 |
| 6,020,297 | * | 2/2000 | Austin et al. | 510/361 |
| 6,024,943 | * | 2/2000 | Ness et al. | 424/59 |
| 6,165,452 | * | 12/2000 | Boden et al. | 424/400 |

FOREIGN PATENT DOCUMENTS

| | | |
|---|---|---|
| 0 819 789 | 1/1998 | (EP) . |
| 1103675 | 2/1968 | (GB) . |
| 2313133 | 11/1997 | (GB) . |
| 95/06154 | 3/1995 | (WO) . |

* cited by examiner

*Primary Examiner*—Diana Dudash
*Assistant Examiner*—Lauren Q. Wells
(74) *Attorney, Agent, or Firm*—Joseph F. Leightner

(57) ABSTRACT

Described is a water-soluble solid-phase ironing aid-freshening composition for use in forming controllably dimensioned tablets, which have controlled weights and densities and which are conveniently added to the water-containing steam chamber of a steam iron. The use of the tablets produced from the composition enables textiles which are ironed to be freshened and de-wrinkled. The composition includes (i) a support substance; (ii) a tablet binder substance; and (iii) a fragrance composition and, optionally, a silicone resin, a chelating agent and/or a surfactant.

30 Claims, 1 Drawing Sheet

WATER-SOLUBLE SOLID-PHASE IRONING AID FRESHENING COMPOSITION TABLETS CONSISTING OF SAME FOR USE IN THE STEAM CHAMBER OF AN IRON AND PROCESS FOR PREPARING AND UTILIZING THE SAME

BACKGROUND OF THE INVENTION

Garments, when washed using harsh detergents or bleaches and subsequently dried, in many instances, evolve subtle undesirable aromas. The use of ironing aids of the prior art on such washed and dried garments, including spray compositions and liquid compositions (for inclusion in the steam chambers of the irons), which include fragrances, have been found to have inherent problems concerning the application of measurable, controllable, effective and consistent quantities of freshening agent (e.g., fragrance and/or malodor maskant) to the garment.

Inventions such as that disclosed in U.S. Pat. No. 5,409,619 (the specification for which is incorporated by reference herein) are primarily concerned with liquid ironing compositions for removal of wrinkles in garments subsequent to washing and drying procedures. U.S. Pat. No. 5,409,619 provides an ironing aid composition comprising from about 60% to about 95% propylene glycol, from about 5% to about 40% of glycerin and from 0% to about 10% of a volatile fragrance. It is stated in U.S. Pat. No. 5,409,619 that a concentrated composition of this type can be added along with water to the chamber of a steam iron in sufficient amount so that the steam chamber contains from about 0.4 up to about 10% of the ironing aid composition. Alternatively, in the disclosure of U.S. Pat. No. 5,409,619, the ingredients of the ironing aid composition can be added to water, thus forming an aqueous composition suitable for pouring directly into the steam chamber, and such aqueous compositions contain from about 0.2% up to about 5% of propylene glycol from about 0.1% up to about 3% of glycerin and, optionally, up to about 0.5% of a volatile fragrance. The concentrated ironing aid composition of U.S. Pat. No. 5,409,619 is introduced in a small amount, for example, drop-wise, into the steam chamber of an iron, most conveniently simultaneously with the introduction of ordinary distilled water or tap water. The amount of concentrated ironing aid composition in the steam iron is recommended in U.S. Pat. No. 5,409,619 to be in the range of from about 0.4% up to about 10%, preferably from about 1% to about 5%. It is further stated in U.S. Pat. No. 5,409,619 that the concentration of ironing aid composition can be dispensed by means of a dropper arrangement which provides substantially accurate measurements, the volume of the dropper dose being set with regard to the volume of the steam chamber. It is further stated in U.S. Pat. No. 5,409,619 that the aqueous ironing aid composition comprises from about 0.2% up to about 5% of propylene glycol, from 0.1% up to about 3% of glycerin and, optionally, up to about 0.5% of a volatile fragrance, and from about 92% up to about 99.7% water.

U.S. Pat. No. 5,409,619 does not expressly or implicitly teach any means for freshening prewashed and dried garments which evolve undesirable odors and the optional utility of up to about 0.5% of a "volatile fragrance" has questionable value in this regard.

Most of the ironing aids heretofore available are in the form of spray starches or sizing products offered in conventional aerosol or trigger spray delivery systems. Thus, for example, U.S. Pat. No. 4,238,057 discloses a spray-type sizing composition comprising a modified low viscosity starch and, to make the iron move smoothly during the ironing operation, a minor amount of dipropylene glycol is added. PCT Published Patent No. 91/19037 discloses the use of a silicone gel for ease of ironing and improvement in the appearance of ironed garments.

U.S. Pat. No. 4,806,254 is principally concerned with a wrinkle-removing spray composition comprising a low molecular weight alcohol, glycerine and a nonionic surfactant, with the only essential ingredient being glycerine. A statement exists in U.S. Pat. No. 4,806,254 that the use of the composition may make ironing easier, but no indication is set forth that the composition can be introduced into the chamber of the steam iron.

Various sizing fabric finishes for use as iron aids are currently on the market, for example, "Magic Sizing Fabric Finish" distributed by the Dial Corporation of Phoenix, Ariz. 85011 containing the following ingredients:

water;
hydrocarbon propellant;
sodium carboxymethyl cellulose;
polyethylene glycol;
silicones;
corrosion inhibitors;
fragrance;
nonionic surfactants; and
preservative.

Another example is the NIAGARA® EASY IRON™ Nonstarch Spray marketed by the Best Foods Division of Corn Products International Inc. of Englewood Cliffs, N.J. 07632-9976. Another product is "Magic Sizing" distributed by Faultless Starch Company of Kansas City, Mo. 64101-1200 containing:

water;
propellant;
sodium carboxymethyl cellulose;
ironing aids;
corrosion inhibitors; and
fragrance.

Although solid or semisolid particles for use as ironing aids (for the purpose of freshening fabrics) are not disclosed in the prior art, solid or semisolid fragrance-releasing materials for other purposes are disclosed in the prior art Thus, U.S. Pat. No. 5,904,028 issued on May 18, 1999 (the specification for which is incorporated by reference herein) discloses a diffusing device containing a face or deodorant material, including a gel of a water-swellable, water-absorbing resin carrying fragrance and/or deodorant components. U.S. Pat. No. 5,904,028 teaches a device for releasing fragrance, deodorant material or mixtures thereof to the atmosphere wherein said device comprises a gel formed from a water-absorbing, gel-forming resin and at least one of said fragrance, said deodorant material or mixtures thereof and a water-insoluble container completely enclosing the gel said container having a water and gas-permeable portion for admitting an aqueous medium containing a fragrance, deodorant or mixture thereof into said gel-forming resin and wherein said device is produced by the process comprising the steps of:

(i) enclosing a water-absorbing, gel-forming resin in a water-insoluble container having at least one water-permeable portion; and (ii) contacting said container with an aqueous medium containing at least one of said fragrance, said deodorant material or mixtures thereof whereby essentially all of said aqueous medium penetrates said permeable portion and is absorbed by said resin to produce said gel containing said fragrance, said deodorant material or mixtures thereof.

The device of U.S. Pat. No. 5,904,028, however, is not a 1 or 2 gram tablet which can be placed into the steam chamber of an iron, but rather is one of a significantly greater size which has a water-absorbing capacity of 50 grams per gram up to about 1,000 grams per gram.

U.S. Pat. No. 5,064,543 issued on Nov. 12, 1991 (the specification for which is incorporated by reference herein) relates to fabric care compositions involving a silicone gel for ease of ironing and better looking garments after ironing, but does not suggest the use of a solid-phase article for incorporation into the steam chamber of an iron which on use thereof enables textiles which are ironed to be freshened and de-wrinkled.

Thus, nothing in the prior art discloses or infers the invention as described herein.

THE INVENTION

Our invention is directed to a water-soluble, solid-phase ironing aid-freshening composition for use in forming controllably dimensional tablets, which have controlled weights and densities and which are conveniently added to the water-containing steam chamber of a steam iron. The use of the tablets produced from the composition of our invention enables the garments which are ironed to be freshened and de-wrinkled. Such garments when washed using harsh detergents or bleaches and subsequently dried in many instances evolve subtle, undesirable aromas, for example, "chlorine bleach" aromas. The composition of our invention when used as indicated herein eliminates such undesirable aromas by means of masking same. The composition of our invention includes:

(i) a support substance;

(ii) a tablet binder substance; and (iii) a fragrance composition and, optionally, a silicone resin, a chelating agent and/or a surfactant.

More particularly, the composition of our invention, the ironing aid freshening composition of our invention comprises:

(a) 70–90 parts by weight of a solid water-soluble noncorrosive support substance soluble in water at least over a temperature range of from about 15° C. up to about 50° C.;

(b) 3–6 parts by weight of a tablet binder substance;

(c) 3–15 parts by weight of (i) a water-soluble fragrance formulation or (ii) a fragrance formulation comprising hydrophobic fragrance components;

(d) optionally, 3–30 parts by weight of a surfactant capable of solubilizing in water hydrophobic fragrance components when (c) is a perfume formulation comprising hydrophobic fragrance components;

(e) 0–5 parts by weight of a silicone resin; and (f) 0–5 parts by weight of a chelating agent.

Our invention also is directed to a process for creating a freshening effect on ironed fabrics including ironed garments comprising the sequential steps of:

(a) admixing (i) 70–90 parts by weight of a solid water-soluble noncorrosive support substance soluble in water at least over a temperature range of from about 15° C. up to about 50° C. with (ii) 3–6 parts by weight of a water-soluble tablet binder and, optionally (iii) 0.5–5 parts by weight of a silicone resin, (iv) 0.5–5 parts by weight of a chelating agent and (v) a surfactant in order to form a support-binder composition;

(b) either providing a water-soluble fragrance or admixing (i) 3–15 parts by weight of a hydrophobic component-containing fragrance formulation with (ii) 3–30 parts by weight of a surfactant capable of solubilizing in water a fragrance containing hydrophobic fragrance components in order to form a fragrance premix;

(c) blending the fragrance premix with the support-binder composition in order to form a fragranced solid phase powder composition;

(d) tableting the fragranced solid phase powder composition whereby fragranced tablets are formed;

(e) admixing at least one of the fragranced tablets with water in order to form an aqueous fragranced tablet formulation solution; and (f) employing the resulting solution in a steam chamber-containing iron whereby the said iron is utilized in a fabric or garment ironing operation.

In the alternative, the fragranced tablets formed in step (d) of the above process may be placed directly into the steam chamber-containing iron. In such case, the steam chamber is previously filled with distilled water or tap water, preferably distilled water. Furthermore, when the tablet produced according to step (d) is used in such a manner, its dimensions must be such as to be conveniently placed into the well of the steam iron.

The volume of the steam chamber of the steam iron varies from about 30 cc up to about 150 cc. The weight range of the thus-formed tablets may vary from about 0.75 grams up to about 2.5 grams, and accordingly, the ratio of tablet weight:water in the steam chamber varies from about 0.005 grams/cc up to about 0.1 gram/cc.

The range of the effective diameter of the thus-formed tablet accordingly varies from about 0.9 cm up to about 1.7 cm as shown by the inequality:

$$0.9 \leqq D_{eff.} \leqq 1.7 (\text{cm})$$

wherein $D_{eff.}$ is the "effective diameter of the tablet." The shape of the tablet may be spherical ellipsoidal or cylindrical.

As stated, supra, the water-soluble non-corrosive support substance should be soluble in water at least over a temperature range of from about 15° C. up to about 50° C. Preferred support substances are as follows:

(i) one or more ammonium, sodium or potassium salts of ethylene diamine tetraacetic acid;

(ii) one or more ammonium, sodium or potassium phosphate, polyphosphate or pyrophosphate salts;

(iii) one or more ammonium, potassium, calcium or magnesium citrate salts;

(iv) one or more ammonium, sodium or potassium gluconate oxalate, tartarate or succinate salts; and (v) one or more ammonium, sodium or potassium $C_1$–$C_4$ alkanoate salts (e.g., formate, acetate, propionate, butyrate or isobutyrate salts).

Preferred tablet binder substances are one or more $C_2$–$C_4$ polyalkylene glycols which have the generic structure:

3 wherein A' and B' are the same or different $C_2$–$C_4$ alkylene; Z is an integer$\leqq$120,000; W is an integer$\leqq$120,000 with the proviso that the sum of Z and W is $\geqq$150 and $\leqq$120,000. Thus, Z and W are the subjects of the following inequalities:

$$O \leqq Z \leqq 120{,}000;\ O \leqq W \leqq 120{,}000;\ \text{and}$$

$$150 \leqq Z+W \leqq 120{,}000.$$

The water-soluble tablet binder may be a solid or liquid. Thus, for example, the water-soluble binder may be PEG 1,500 (polyethylene glycol having 1,500 ethoxy units wherein the sum of Z and W is 1,500 and A' and B' are the same and each represents ethylene).

Other tablet binder materials useful in the practice of our invention are as follows:

PEG-150;

PEG-200;

PEG-350;

PEG-2M;

PEG-5M;

PEG-7M;

PEG-9M;

PEG-14M;

PEG-20M;

PEG-23M;

PEG-45M;

PEG-90M;

PEG-u15M; and

Poloxymer 407 wherein A' is ethylene, B' is propylene and wherein Z is 196 and W is 67.

When water-soluble fragrance components are used (solely), such water-soluble fragrance components have n-octanol/water partitioning coefficients of less than about 1,000 or "C $\log_{10}$P" of less than about 3.

The logP of many perfume ingredients has been reported, for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (C $\log_{10}$P) is determined by the fragment approach of Hansch and Leo (cf, A. Leo in *Comprehensive Medicinal Chemistry*, Volume 4, C. Hansch, P. G. Sammens, J. B. Taylor and C. A. Ramsden, Editors, page 295, Pergamon Press, 1990, incorporated herein by reference). The fragment approach is based on the chemical structure of each perfume ingredient and takes into account the numbers and types of atoms, the atom connectivity and chemical bonding. The C $\log_{10}$P values, which are the most reliable and widely used estimates for this physicochemical property, are preferably used instead of the experimental logP values in the selection of perfume ingredients which are useful in the present invention.

Thus, examples of components of water-soluble fragrances are as follows (with their C $\log_{10}$P values):

TABLE 1

| Water-soluble Perfume Component | C $\log_{10}$P Value |
|---|---|
| Benzaldehyde | 1.480 |
| Geraniol | 2.649 |
| Linalool | 2.429 |
| Nerol | 2.649 |
| Phenylethyl alcohol | 1.183 |
| Eugenol | 2.307 |
| Isoeugenol | 2.547 |
| α-Terpineol | 2.569 |
| Hydroxycitronellal | 1.541 |
| Vanillin | 1.580 |

Examples of fragrance components, which are part of the fragrance compositions useful in the practice of our invention, which have a C $\log_{10}$P greater than 3.0 and which are hydrophobic, are as follows:

| Fragrance Component | C $\log_{10}$P Value |
|---|---|
| Allyl cyclohexane propionate | 3.935 |
| Ambrettolide | 6.261 |
| Amyl benzoate | 3.417 |
| Amyl cinnamate | 3.771 |
| Amyl cinnamic aldehyde | 4.324 |
| Amyl cinnamic aldehyde dimethyl acetal | 4.033 |
| iso-Amyl salicylate | 4.601 |
| Aurantiol | 4.216 |
| Benzophenone | 3.120 |
| Benzyl salicylate | 4.383 |
| para-tert-Butyl cyclohexyl acetate | 4.019 |
| iso-Butyl quinoline | 4.193 |
| β-Caryophyllene | 6.333 |
| Cadinene | 7.346 |
| Cedrol | 4.530 |
| Cedryl acetate | 5.436 |
| Cedryl formate | 5.070 |
| Cinnamyl cinnamate | 5.480 |
| Cyclohexyl salicylate | 5.265 |
| Cyclamen aldehyde | 3.680 |
| Dihydro isojasmonate | 3.009 |
| Diphenyl methane | 4.059 |
| Diphenyl oxide | 4.240 |
| Dodecalactone | 4.359 |
| ISO E SUPER ® (registered trademark of International Flavors & Fragrances Inc. of New York, NY) | 3.455 |
| Ethylene brassylate | 4.554 |
| Ethyl methyl phenyl glycidate | 3.165 |
| Ethyl undecylenate | 4.888 |
| Exaltolide | 5.346 |
| GALOXOLIDE ® (registered trademark of International Flavors & Fragrances Inc. of New York, NY) | 5.482 |
| Geranyl anthranilate | 4.216 |
| Geranyl phenyl acetate | 5.233 |
| Hexadecanolide | 6.805 |
| Hexenyl salicylate | 4.716 |
| Hexyl cinnamic aldehyde | 5.473 |
| Hexyl salicylate | 5.260 |
| α-Irone | 3.820 |
| LILIAL ® (p-t-bucinal) | 3.858 |
| Linalyl benzoate | 5.233 |
| 2-Methoxy naphthalene | 3.235 |
| Methyl dihydrojasmone | 4.843 |
| γ-n-Methyl ionone | 4.309 |
| Musk indanone | 5.458 |
| Musk ketone | 3.014 |
| Musk tibetine | 3.831 |
| Myristicin | 3.200 |
| Oxahexadecanolide-10 | 4.336 |
| Oxahexadecanolide-11 | 4.336 |
| Patchouli alcohol | 4.530 |
| Phantolide | 5.977 |
| Phenyl ethyl benzoate | 4.058 |
| Phenylethylphenyl acetate | 3.767 |
| Phenyl heptanol | 3.478 |
| Phenyl hexanol | 3.299 |
| α-Santalol | 3.800 |
| Thibetolide | 6.246 |
| δ-Undecalactone | 3.830 |
| γ-Undecalactone | 4.140 |
| Vetiveryl acetate | 4.882 |
| Yara-yara | 3.235 |
| Ylangene | 6.268 |
| iso-Bornyl acetate | 3.485 |
| Carvacrol | 3.401 |
| α-Citronellol | 3.193 |
| para-Cymene | 4.068 |
| Dihydro myrcenol | 3.030 |
| Geranyl acetate | 3.715 |
| d-Limonene | 4.232 |
| Linalyl acetate | 3.500 |
| VERTENEX ® (registered trademark of International Flavors & Fragrances Inc. of New York, NY) | 4.060 |

Other materials, which are hydrophobic components of fragrances useful in the practice of our invention and which have deodorancy properties, are those disclosed and claimed in Application for U.S. Pat. Ser. No. 09/358,000 filed on Jul. 21, 1999 entitled "CONDENSATION PRODUCTS OF ALDEHYDES, KETONES AND ALCOHOLS; ORGANOLEPTIC USES THEREOF AND PROCESS FOR PREPARING SAME." Materials specifically disclosed in Application for U.S. Pat. Ser. No. 09/358,000 useful in the practice of our invention are as follows:

(a) at least one acetal produced by means of reacting:
  (i) the aldehydes: hexylcinnamic aldehyde; LILIAL®; heliotropine; LYRAL®; AUBEPINE™; undecylenic aldehyde; and/or dodecanal with
  (ii) the carbinols: citronellol; nerol; geraniol; dihydromyrcenol; β-phenyl ethyl alcohol; tetrahydrolinalool; ROSALVA®; and/or undecavertol;

(b) at least one hemiacetal produced by means of reacting:
  (i) the aldehydes: hexylcinnamic aldehyde; LILIAL®; heliotropine; LYRAL®; AUBEPINE™; undecylenic aldehyde; and/or dodecanal With
  (ii) the carbinols: citroneilol; nerol; geraniol; dihydromyrcenol; β-phenyl ethyl alcohol; tetrahydrolialool; ROSALVA®; and/or undecavertol;

(c) at least one ketal produced by means of reacting:
  (i) the ketones: hedione; methyl ionone; and/or ISO-CYCLEMONE E®; and
  (ii) the carbinols: citronellol; nerol; geraniol; dihydromyrcenol; β-phenyl ethyl alcohol; tetrahydrolinalool; ROSALVA®; and/or undecavertol;

(d) at least one hemiketal produced by means of reacting:
  (i) the ketones: hedione; methyl ionone; and/or ISO-CYCLEMONE E®; and
  (ii) the carbinols: citronellol; nerol; geraniol; dihydromyrcenol; β-phenyl ethyl alcohol; tetrahydrolinalool; ROSALVA®; and/or undecavertol;

(e) at least one cyclic inacetal or mixed triacetal of at least one aldehyde selected from the group consisting of:
  LIIAL®;
  heliotropine;
  AUBEPINE™;
  undecylenic aldehyde;
  dodecanal; and/or
  LYRAL®;

(f) the trimer of AUBEPINE™ having the structure:

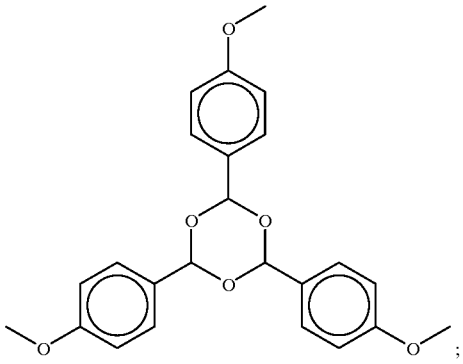

;

(g) The mixed acetal of AUBEPINE™, ROSALVA® and geraniol having the structure:

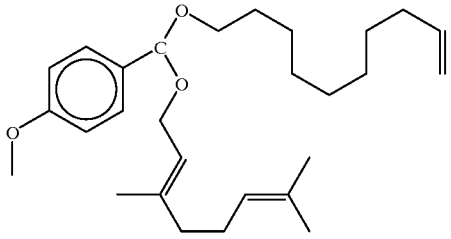

; and (h) The mixed trimer of AUBEPINE™ and hehotropine having the structure:

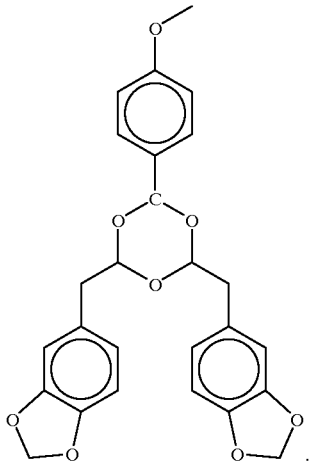

.

By the term "AUBEPINE™" is meant the compound having the structure:

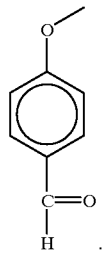

.

By the term "ROSALVA®" (trademark of International Flavors & Fragrances Inc.) is meant the compound having the structure:

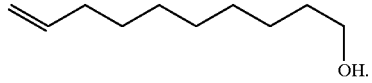

OH.

By the term "LYRAL®" (trademark of International Flavors & Fragrances Inc.) is meant the mixture of compounds defined according to the structure:

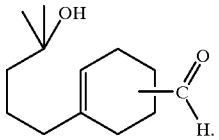

By the term "hexylcinnamic aldehyde" is meant the compound having the structure:

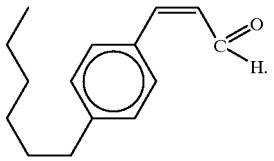

By the term "nerol" is meant the compound having the structure:

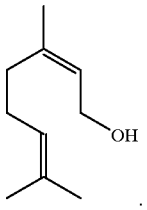

By the term "ISOCYCLEMONE E®" is meant the compound having the structure:

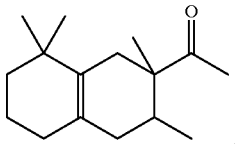

When using fragrance compositions containing hydrophobic fragrance components as stated, supra, 3–30 parts by weight of a surfactant capable of solubilizing in water such hydrophobic fragrance components are needed in the composition of our invention. Such surfactants may be anionic, nonionic, cationic or zwitterionic detergents. For example, the following nonionic surfactants having the following structures are useful in the practice of our invention:

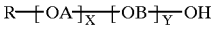

wherein X is an integer of from 0–30 and Y is an integer of from 0–30 with the proviso:

$$1 \leqq X+Y \leqq 60$$

and wherein A and B are the same or different $C_2$–$C_4$ alkylene; and R is $C_3$–$C_{20}$ alkyl, hydroxyalkyl or dihydroxyalkyl; and wherein the number of carbon atoms is defined by the following inequality:

$$14 \leqq \Sigma C \leqq 135;$$

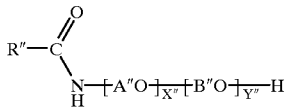

wherein A" and B" are the same or different $C_2$–$C_4$ alkylene and wherein X" and Y" are each the same or different integers of from 0 up to 30 with the proviso:

$$2 \leqq X''+Y'' \leqq 30;$$

and wherein the total number of carbon atoms varies from 50 up to 500 according to the inequality:

$$50 \leqq \Sigma C \leqq 500;$$

and wherein R" represents alkyl;

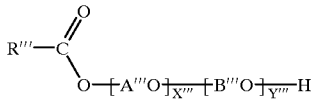

wherein A'" and B'" are the sa me or different $C_2$–$C_4$ alkylene; wherein R'" is alkyl; and wherein X'" and Y'" are each integers of from 0 up to 50 governed by the inequality:

$$2 \leqq X'''+Y''' \leqq 80;$$

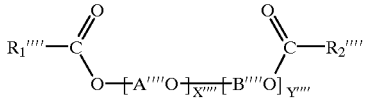

wherein A'" and B'" represent the same or different $C_2$–$C_4$ alkylene; wherein $R_1$'" and $R_2$'" are the same or different alkyl; wherein X'" and Y'" represent integers of from about 2 up to about 150 with the proviso:

$$2 \leqq X''''+Y'''' \leqq 150$$

and further with the proviso that the total number of carbon atoms varies from 20 up to 350 according to the inequality:

$$20 \leqq \Sigma C \leqq 350;$$

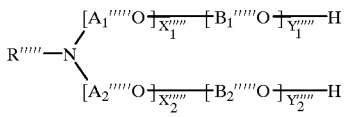

wherein each of $A_1$'''''; $B_1$'''''; $A_2$'''''; and $B_2$''''' each represent the same or different $C_2$–$C_4$ alkylene; wherein each of $X_1$'''''; Y'''''; $X_2$'''''; and $Y_2$''''' each represent integers of from 0 to 30 with the provisos:

$$1 \leqq [X_1''''' + Y_1'''''] \leqq 30;\ 1 \leqq [X_2''''' + Y_2'''''] \leqq 30;\ \text{and}$$

$$2 \leqq [X_1''''' + Y_1''''' + X_2''''' + Y_2'''''] \leqq 40$$

and with the further proviso that the number of carbon atoms may vary from 20 up to 250 according to the inequality:

$$20 \leqq \Sigma C \leqq 250;$$

the compounds defined according to the structure:

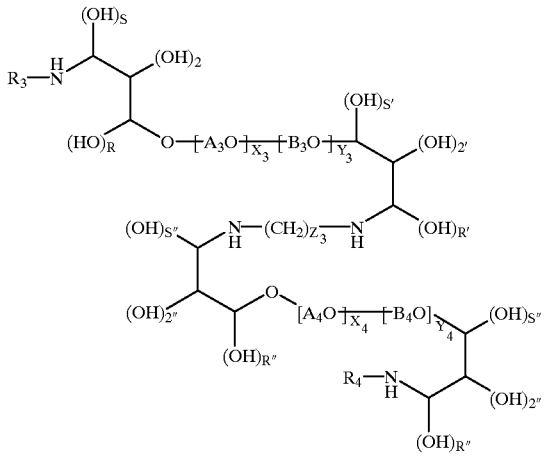

wherein $R_3$ and $R_4$ represent $C_{10}$–$C_{100}$ and wherein each of q, R, S, q', R', S', q", R" and S" each represent 0 or 1; wherein $Z_3$ is an integer of between 2 and 10; wherein $X_3$, $Y_3$, $X_4$ and $Y_4$ are integers of from 5 up to 30 with the provisos:

$$1 \leqq \Sigma[q+R+S] \leqq 3;\ 1 \leqq \Sigma[q'+R'+S'] \leqq 3;$$

$$1 \leqq \Sigma[q''+R''+S''] \leqq 3;\ 2 \leqq Z_3 \leqq 10;$$

$$5 \leqq X_3+Y_3 \leqq 30;\ 5 \leqq X_4+Y_4 \leqq 30;\ \text{and}$$

$$10 \leqq [X_3+Y_3+X_4+Y_4] \leqq 60.$$

The total number of carbon atoms varies in this particular molecule from between 60 and 600 according to the inequality:

$$60 \leqq \Sigma C \leqq 600.$$

Examples of the aforementioned surfactants are the material having the structure:

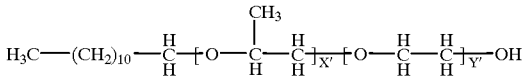

wherein the average value of X' is 1 and the average value of Y' is 9 (otherwise known as PPG-3-laureth-9). Examples of other materials which are useful in the practice of our invention as surfactants and emulsifying agents are:

laureth4;
laureth-5;
laureth-6;
laureth-7;
laureth-8;
PEG-8 caprate;
PEG-8 caprylate;
PEG-8 caprylate/caprate;
PEG-6 caprylic/capric glycerides;
PEG-3 cocamide;
PEG-5 cocamide;
PEG-6 cocamide;
PEG-7 cocamide;
PEG-11 cocamide;
PEG-2 cocamine;
PEG-3 cocaine;
PEG-5 cocamine;
PEG-10 cocamine;
PEG-15 cocamine;
PEG-5 cocoate;
PEG-8 cocoate;
PEG-15 cocoate;
PEG-2 cocomonium chloride;
PEG-15 cocomonium chloride;
PEG-15 cocopolyamine;
PEG-4 dilaurate;
PEG-6 dilaurate;
PEG-8 dilaurate;
PEG-12 dilaurate;
PEG-20 dilaurate;
PEG-32 dilaurate;
PEG-75 dilaurate;
PPG-2-buteth-3;
PPG-5-buteth-7;
PPG-7-buteth-10;
PPG-9-buteth-12;
PPG-12-buteth-16;
PPG- 15-buteth-20;
PPG-20-buteth-30;
PPG-24-buteth-27;
PPG-26-buteth-26;
PPG-33 butyl ether;
PPG-40 butyl ether;
PPG-52 butyl ether;
PPG-53 butyl ether;
PPG-2-ceteareth-9;
PPG 4-ceteareth-12;
PPG-10-ceteareth-20;
PPG-1-ceteth-1;
PPG-1-ceteth-5;
PPG-1-ceteth-10;
PPG-1-ceteth-20;
PPG-2-ceteth-1;
PPG-2-ceteth-5;
PPG-55 glyceryl ether;
PPG-2-isodeceth-6;
PPG-30 isocetyl ether;
PPG-3-isostearetn-9; and
PPG-12laneth-50.

Formation of the emulsions as per step (b), supra, of the process of our invention when hydrophobic fragrances are used may be carried out according to the techniques set forth in Friberg, et al "Stability factors and vapor pressures in a model fragrance emulsion system," *JOURNAL OF COSMETIC SCIENCE*, Volume 50, No. 4, pages 203–219 (July/August 1999). Thus, our invention not only contemplates two-phase emulsions which are "oil-in-water" but also three-phase emulsions (oil plus liquid crystal)-in-water as well as liquid crystal-in-water emulsions.

Of particular preferred utility with respect to deodorization fragrances are the following two materials which are hydrophobic fragrance components:

(a) at least one acetal produced by reacting hexyl cinnamic aldehyde with at least one of citronellol nerol geraniol dihydromyrcenol a phenyl ethyl alcohol and/or a tetahydrolinalool; and (b) at least one hemiacetal produced by reacting hexyl cinnamic aldehyde with at least one of citronellol nerol geraniol, dihydromyrcenol a phenyl ethyl alcohol and/or a tetrahydrolinalool.

As stated, supra, the ironing aid freshening composition of our invention may also comprise 0–5 parts by weight of a silicone resin (for the purpose of finishing the garments) and 0–5 parts by weight of a chelating agent.

Examples of silicone resins useful in the practice of our invention are polyalkylene oxide modified polydimethyl siloxanes, for example, polypropylene oxide modified polydimethyl siloxanes, polybutylene oxide modified polydimethyl siloxanes and polyethylene oxide modified polydimethyl siloxanes.

Other polysiloxanes useful in the practice of our invention are those set forth in U.S. Pat. No. 4,552,777 issued on Nov. 17, 1985, the specification for which is incorporated by reference herein, and these include dimethyl polysiloxane. Other polysiloxanes are disclosed in U.S. Pat. No. 5,043,543 issued on Nov. 12, 1991, entitled "SILICONE GEL FOR EASE OF IRONING AND BETTER LOOKING GARMENTS AFTER IRONING" and these include a branched curable amine functional silicone having the following structure:

$$[(RO)R_2'SiO_{1/2}]_x[R_2'SiO]_y[R''SiO_{3/2}]_z$$

wherein X is equal to Z+2; Y is at least 3; wherein Z is at least 1; wherein $R_1'$ and $R_1''$ are each the same or different $C_1$–$C_{20}$ alkyl or an amine group selected from cyclicamino, polyamino and alkylamino having from about 2 up to about 7 carbon atoms in their alkyl chains; and wherein at least one of R' or R" is an amine group.

An example of a polyalkylene oxide-modified polydimethyl siloxane polymer is SILWET® Copolymer L-7622 manufactured by the Witco Chemical Company.

Other dimethyl polysiloxanes of the formula:

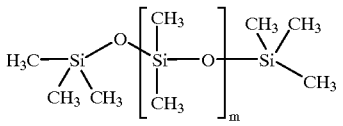

wherein m is an integer of from 1–6; and of the formula:

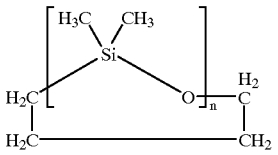

wherein n is an integer of from 4 up to 6, are useful in the practice of our invention. Preferably, in the above-mentioned structures, n is 5 or 6 and m is 5 or 6.

The aforementioned two structures are set forth in Published Japanese Application No. JP111/28331 assigned to the Taiyo Perfumery Company, Ltd. and published on May 18, 1999 (Derwent Accession No. 1999-3507-39/30).

Additional optional chelating agents that are useful in the practice of our invention are as follows:

citric acid;

sodium, potassium, magnesium, calcium and ammonium salts of citric acid;

gluconic acid;

sodium, potassium and ammonium salts of gluconic acid;

oxalic acid;

ammonium, potassium and sodium salts of oxalic acid;

tartaric acid;

sodium, potassium and ammonium salts of tararic acid;

succinic acid; and sodium, potassium and ammonium salts of succinic acid.

The above salts may be mono or dibasic in the case of oxalic acid, tatric acid and succinic acid and may be mono, di and tribasic in the case of citric acid. Additional optional chelating agents are those defined according to the structure:

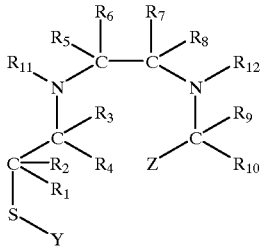

as exemplified in U.S. Pat. No. 5,955,053 issued on Sep. 21, 1999 and incorporated herein by reference wherein:

$R_1$–$R_{10}$ are individually selected from the group consisting of hydrogen, a straight or branched, unsubstituted or substituted alkyl having C=1–4, and ACOOH wherein A is a straight or branched, unsubstituted or substituted alkyl group having C=0–4;

$R_5$ together with $R_6$, R7 together with $R_8$, and $R_9$ together with $R_{10}$ may form an oxygen atom, $R_{11}$ and $R_{12}$ are individually selected from the group consisting of a hydrogen, an alkyl having C=1–4, a hydroxy-alkyl, and ACOOH wherein A is a sight or branched, unsubstituted or substituted alkyl group having C=0–4;

Z is selected from the group consisting of

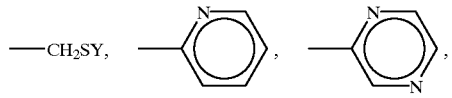

$—CH_2NH_2$, $—CH_2NH(CH_2)_qCH_3$ where q=0–3 and $—CH_2NH(CH_2)_pCOOH$ where p=1–3; and Y is a hydrogen atom or a suitable protecting group;

with the provision that (a) at least one of $R_1$–$R_{10}$ is ACOOH or, together with one other R group, forms an oxygen atom; and/or (b) only one of $R_1$, $R_2$, $R_3$ or $R_4$ and $R_5$, $R_6$, $R_7$ or $R_8$ and $R_9$ or $R_{10}$ is a straight or branched, unsubstituted or substituted alkyl of $C_3$ or $C_4$ or is an ACOOH wherein A is a straight or branched, unsubstituted or substituted alkyl group having C=0–4.

Examples of such materials are set forth in the Table at columns 27–33 of said U.S. Pat. No. 5,955,053 and are as follows:

TABLE
| Cysteinylethylene (EC)-based ligands |
|---|
| 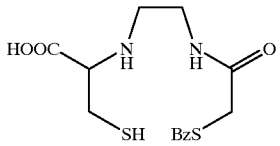 L-CEMA |
| 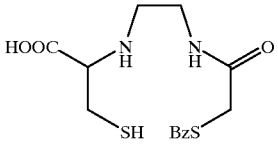 D-CEMA |
| 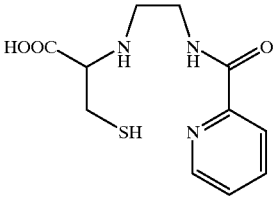 L-CEPIC |
| 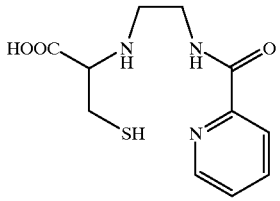 D-CEPIC |
| 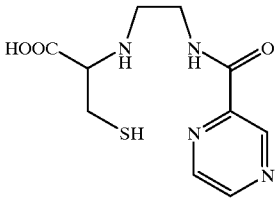 L-CEPZ |
| 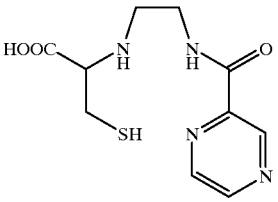 L-CEPZ |
| 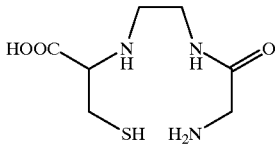 CEG |
| 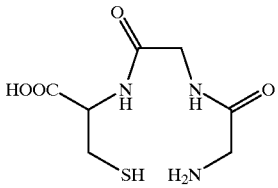 CGG |
| 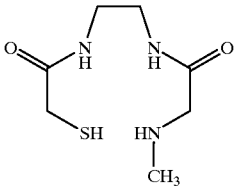 TDAA-CH3 |
| 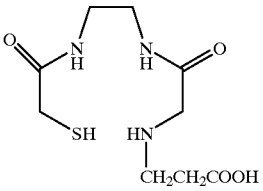 TDAA-EtCOOH |
TABLE
| Thioacetamidethiourea (TATU)-based ligand |
|---|
| 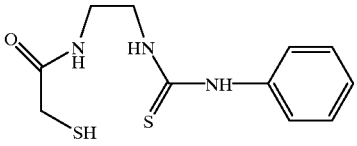 TATU-Ph |
| 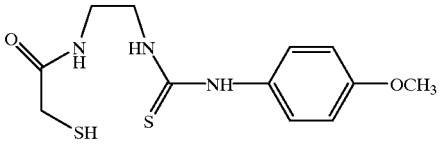 TATU-Ph-$OCH_3$ |
| 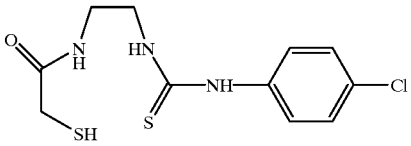 TATU-PhCl |
| 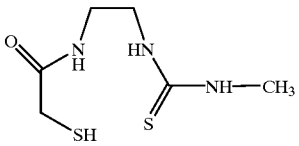 TATU-$CH_3$ |

TABLE-continued
| Thioacetamidethiourea (TATU)-based ligand |
| --- |
| 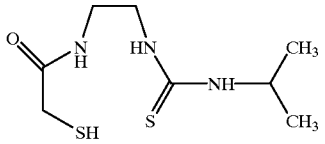 TATU-$(Me)_2$ |
| 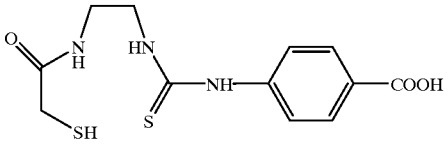 TATU-pPHCOOH |
| 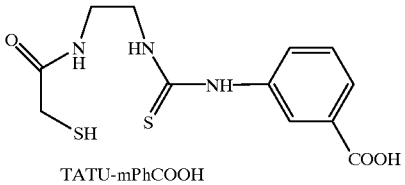 TATU-mPhCOOH |
| 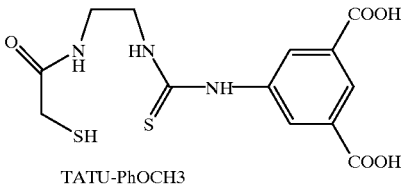 TATU-PhOCH3 |
| 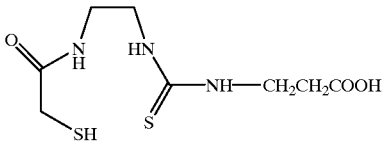 TATU-EtCOOH |
| 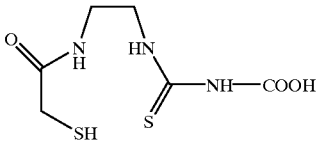 TATU-COOH |
| 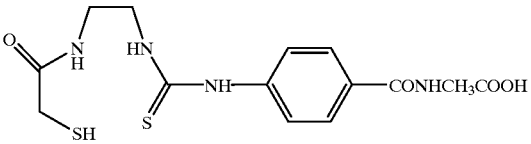 TATU-hippuric acid |
| 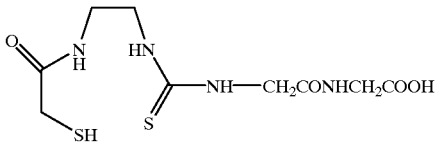 TATU-GlyGly |
| 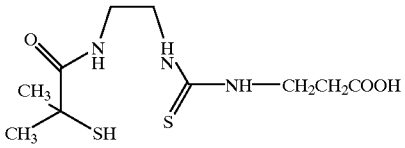 $(Me)_2$-TATU-EtCOOH |
| 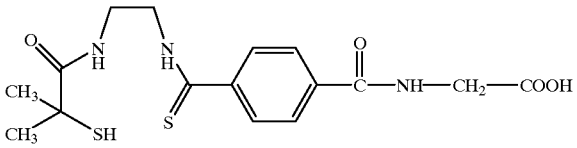 $(Me)_2$-TATU-hippuric acid |
| 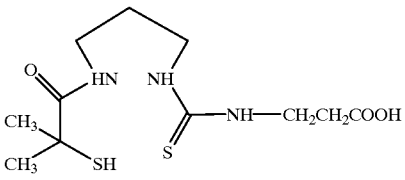 $(Me)_2$-TAPTU-EtCOOH |
| 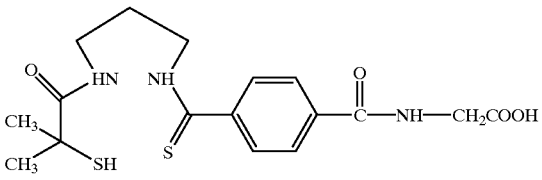 $(Me)_2$-TATU-hippuric acid |

TABLE

Dithiourea (DTU)-based ligands

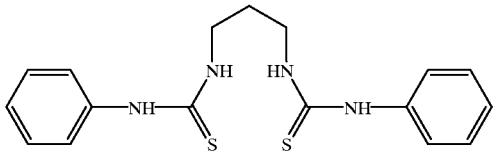

DTU-Ph

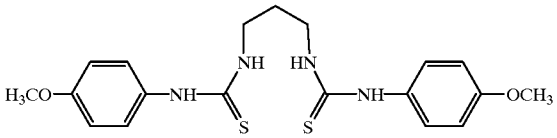

DTU-PhOCH

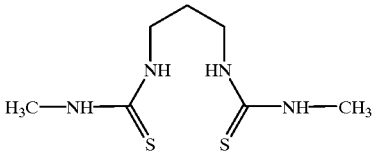

DTU-$CH_3$

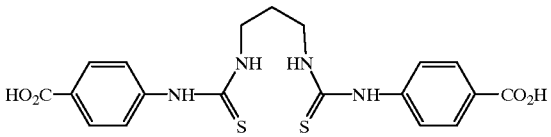

DTU-PhCOOH

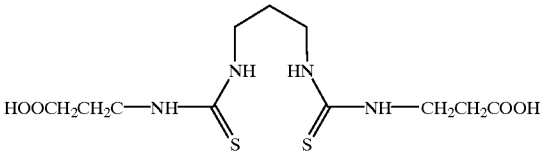

DTU-EtCOOH

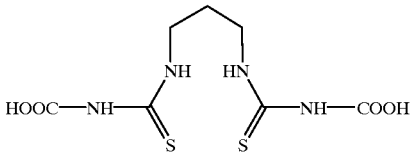

DTU-COOH

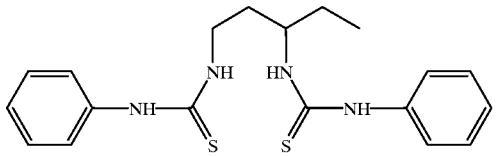

Et-DTU-Ph

TABLE-continued

Dithiourea (DTU)-based ligands

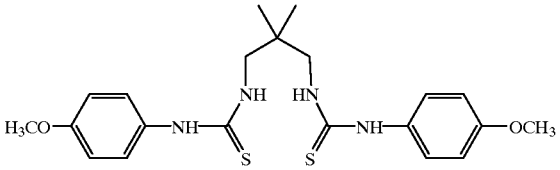

$(Me)_2$-DTU-$PhOCH_3$

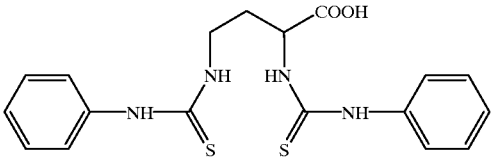

COOH-DTU-Ph

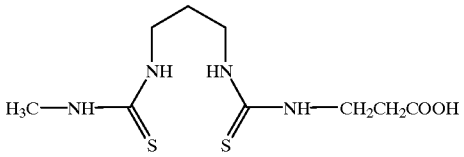

DTU-CH3,EtCOOH

Other optional chelating agents include tetrapotassium ethylene diamine tetra acetate, tetra ammonium ethylene diamine tetra acetate and mixtures thereof as disclosed in U.S. Pat. No. 5,948,741 issued on Sep. 7, 1999, the specification for which is incorporated by reference herein. Other optional chelating agents include tripotassium ethylene diamine tetra acetate or tiammonium ethylene diamine tetra acetate or mixtures thereof as disclosed in U.S. Pat. No. 5,948,742, the specification for which is incorporated by reference herein.

The citric acid, gluconic acid, oxalic acid and tartaric acid and salts thereof chelating agents are specifically described in *TECHNICAL BULLETIN NO.* 32, published by the Pfizer Chemicals Division located at 235 East 42nd Street, New York, N.Y. 10017 as *TECHNICAL BULLETIN NO.* 32/*PFIZER ORGANIC CHELATING AGENTS.*

The tableting step of the process of our invention is carried out using tableting apparatus well known to those having ordinary skill in the art Each of the tablets is created in order to have a weight of from about 0.75 up to about 2.5 grams and as stated, supra, an effective diameter of from about 0.9 up to about 1.7 cm. Each of the tablets may be formed into any convenient geometric shape, e.g., spheres, ellipsoids, cylinders, elliptical cylinders, cones, conical frustums, tetrahedrons, polyhedrons including hexahedrons and elliptical cylinders. The tableting process is carried out at a pressure of from about 35 psig up to about 60 psig for a time period of from about 30 seconds up to about 60 seconds.

The resulting tablets as stated, supra, may then be dissolved in distilled water or tap water and the resulting solution may then be incorporated into the steam chamber of a steam chamber-containing iron. In the alternative, the resulting tablet may be added to the water after the water is placed in the steam chamber of the steam chamber-containing iron.

DETAILED DESCRIPTION OF THE DRAWING

Figure 1:
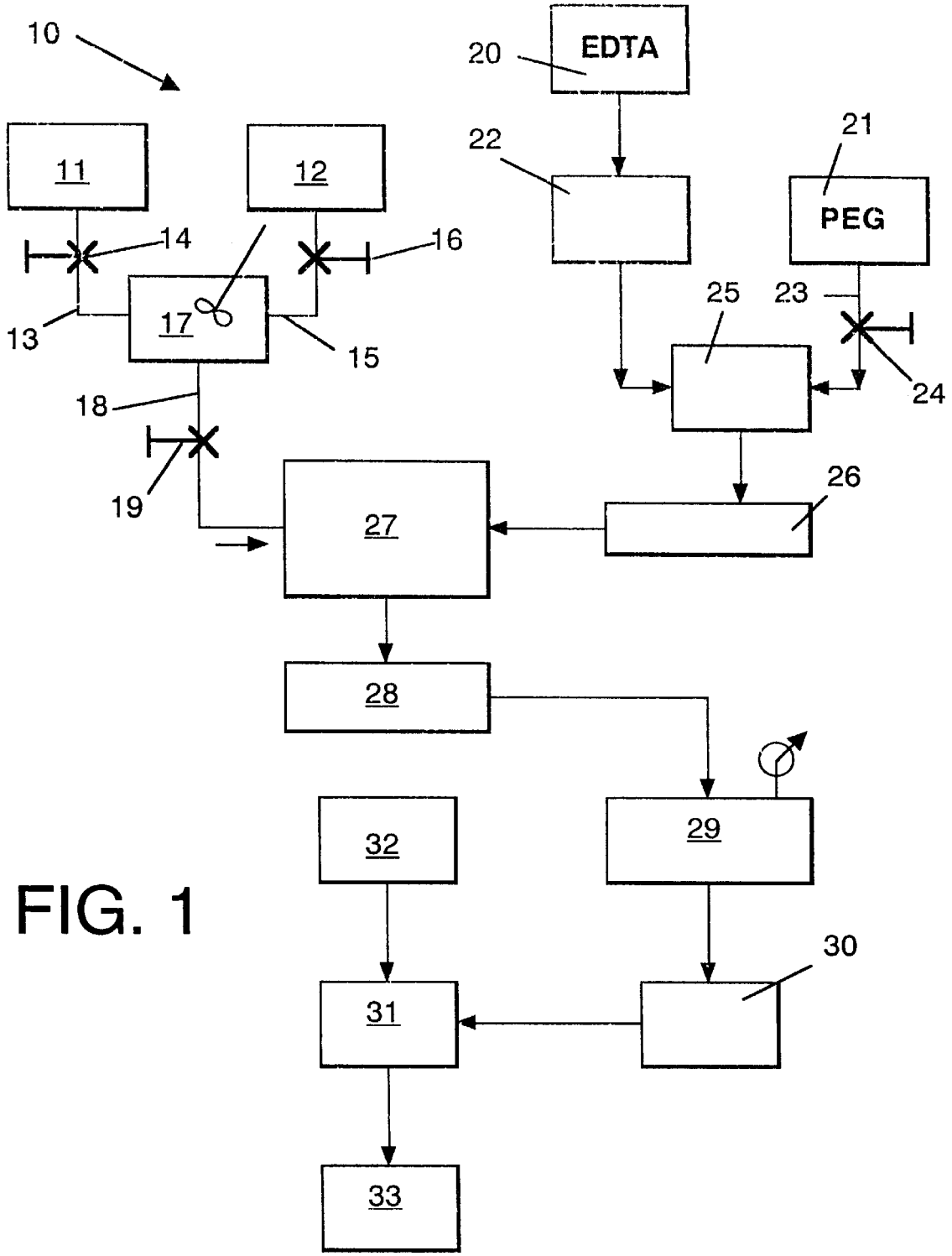
FIG. 1 is a schematic block flow diagram showing an embodiment of the process of our invention.

Referring to FIG. 1, wherein 10 refers to the process of the invention, perfume containing hydrophobic components at location 12 is fed into mixing vessel 17 past control valve 16 through line 15. Simultaneously, an emulsifier, for example, EUMULGIN® L (trademark of the Henkel Corporation of Dusseldorf, Germany), stored at location 11 is fed into mixing vessel 17 through line 13 past valve 14. Simultaneously, solid water-soluble, noncorrosive support substance located at the location indicated by reference numeral 20 is fed via conveyor 22 into solids mixing vessel 25. Simultaneously, a water-soluble tablet binder (e.g., polyethylene glycol 1,500) is fed from location 21 through conveyance means 23/24 into mixing vessel 25. The tablet binding agent can be a solid or a liquid, and if it is a liquid, the liquid is fed through line 23 past control valve 24. If it is a solid, the reference numerals 23/24 represent a solids conveying means. The resulting solid mixture is conveyed by means of conveyor 26 into solids mixing vessel 27 where it is mixed with the fragrance premix coming from vessel 17 through line 18 past valve 19. The mixing of the various ingredients takes place at location 27. The resulting mixture is conveyed from mixing vessel 27 via conveying means 28 into the tableting apparatus 29. The resulting tablets evolved from the tableting apparatus to location 30 are then placed in the steam chamber of an iron at location 31 together with water coming from location 32. On operation of the iron on garments, steam and fragrance is evolved as shown using reference numeral 33.

The following example is illustrative and our invention is only limited as defined by the appended claims.

EXAMPLE I

PART (A) PREPARATION OF FRAGRANCE

The following fragrance formulation is prepared:

| Ingredients | Parts by Weight |
|---|---|
| Citric acid powdered anhydrous | 1.00 |
| Citronellol coeur | 30.00 |
| Dihydromyrcenol | 50.00 |
| Geraniol | 25.00 |
| Hexylcinnamic aldehyde | 100.00 |
| LILIAL ® | 50.00 |
| LYRAL ® | 30.00 |
| ROSALVA ® | 5.00 |
| Tetrahydrolinalool | 100.00 |
| Undecavertol | 3.00 |

The resulting mixture is stirred for a period of 72 hours.

The resulting product is used in Part (B).

EXAMPLE I

PART (B)

6.0 Parts by weight of the perfume composition prepared in Part (A) is admixed with 6.0 parts by weight of EUMULGIN® L having the structure:

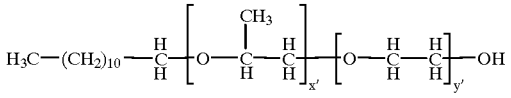

wherein the average value of X' is 1 and the average value of Y' is 9 (trademark of Henkel A. G. of Dusseldorf, Germany) in order to form a "fragrance premix."

Simultaneously, 82.0 parts by weight of the tetrasodium salt of ethylene diamine tetra acetic acid is admixed with 4.0 parts of PEG-1,500 having the structure:

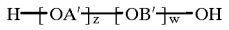

wherein A' and B' are each ethylene and the sum of Z plus W is 1,500 in order to form a support-binder composition.

The support-binder composition is then admixed with the fragrance premix and 2.0 parts by weight of SILWET® Copolmyer L-7622 (trademark of the Witco Chemical Company of Amsterdam, Kingdom of the Netherlands) (polyalkylene oxide-modified polydimethyl siloxane).

The resulting product is blended for a period of 30 minutes.

The resulting blend is then tableted at 40 psig for 40 seconds. Tablets weighing 1.5 grams are produced.

One tablet is placed in a steam iron containing 100 cc of distilled water. The steam iron is used to iron a wrinkled garment previously washed using TIDE® Detergent and CLOROX® Bleach.

After a standard ironing procedure has taken place, the resulting garment had no wrinkles and had no malodor, but did have a very weak, pleasant lilac-"fresh air" nuance.

What is claimed is:

1. A method for creating a freshening effect on ironed fabrics comprising the sequential steps of:

(a) admixing (i) 70–90 parts by weight of a solid water-soluble noncorrosive support substance selected from the group consisting of:

(i) one or more ammonium salts of ethylene diamine tetra acetic acid; one or more sodium salts of ethylene diamine tetra acetic acid; or one more potassium salts of ethylene diamine tetra acetic acid;

(ii) one or more ammonium phosphate salts; one or more sodium phosphate salts; one or more potassium phosphate salts; one or more ammonium polyphosphate salts; one or more sodium polyphosphate salts; one or more potassium polyphosphate salts; one or more ammonium pyrophosphate salts; one or more sodium pyrophosphate salts; or one or more potassium pyrophosphate salts;

(iii) one or more ammonium citrate salts; one or more sodium citrate salts; one or more potassium citrate salts; one or more calcium citrate salts or one or more magnesium citrate salts;

(iv) one or more ammonium gluconate salts; one or more sodium gluconate salts; one or more potassium gluconate salts; one or more ammonium oxalate salts; one or more sodium oxalate salts; one or more potassium oxalate salts; one or more ammonium tartarate salts; one or more sodium tartarate salts; one or more potassium tartarate salts; or one or more ammonium succinate salts; one or more sodium succinate salts or one or more potassium succinate salts; and (v) one or more ammonium $C_1$–$C_4$ alkanoate salts; one or more sodium $C_1$–$C_4$ alkanoate salts or one or more potassium $C_1$–$C_4$ alkanoate salts soluble in water at least over a temperature range of from about 15° C. up to about 50° C. with (ii) 3–6 parts by weight of a water-soluble tablet binder and, optionally (iii) 0.5–5 parts by weight of a silicone resin, optionally (iv) 0.5–5 parts by weight of a chelating agent and optionally (v) a surfactant in order to form a support-binder composition;

(b) either providing a water-soluble fragrance or admixing (i) 3–15 parts by weight of a hydrophobic component-containing fragrance formulation with (ii) 3–30 parts by weight of a surfactant capable of solubilizing in water a fragrance containing hydrophobic fragrance components in order to form a fragrance premix;

(c) blending the fragrance premix with the support-binder composition in order to form a fragranced solid phase powder composition;

(d) tableting the fragranced solid phase powder composition to have a diameter of from about 0.9 cm to about 1.7 cm whereby fragranced tablets are formed;

(e) admixing at least one of the fragranced tablets with water in order to form an aqueous fragranced tablet formulation solution; and (f) employing the resulting solution in a steam chamber-containing iron whereby the said iron is utilized in a fabric ironing operation.

2. An ironing aid freshening composition comprising:

(a) 70–90 parts by weight of a solid water-soluble non-corrosive support substance selected from the group consisting of:

(i) one or more ammonium salts of ethylene diamine tetra acetic acid; one or more sodium salts of ethylene diamine tetra acetic acid; or one more potassium salts of ethylene diamine tetra acetic acid;

(ii) one or more ammonium phosphate salts; one or more sodium phosphate salts; one or more potassium phosphate salts; one or more ammonium polyphosphate salts; one or more sodium polyphosphate salts; one or more potassium polyphosphate salts; one or more ammonium pyrophosphate salts; one or more sodium pyrophosphate salts; or one or more potassium pyrophosphate salts;

(iii) one or more ammonium citrate salts; one or more sodium citrate salts; one or more potassium citrate salts; one or more calcium citrate salts or one or more magnesium citrate salts;

(iv) one or more ammonium gluconate salts; one or more sodium gluconate salts; one or more potassium gluconate salts; one or more ammonium oxalate salts; one or more sodium oxalate salts; one or more potassium oxalate salts; one or more ammonium tartarate salts; one or more sodium tartarate salts; one or more potassium tartarate salts; or one or more ammonium succinate salts; one or more sodium succinate salts or one or more potassium succinate salts; and (v) one or more ammonium $C_1$–$C_4$ alkanoate salts; one or more sodium $C_1$–$C_4$ alkanoate salts or one or more potassium $C_1$–$C_4$ alkanoate salts soluble in water at least over a temperature range of from about 15° C. up to about 50° C.;

(b) 3–6 parts by weight of a tablet binder substance;

(c) 3–15 parts by weight of (i) a water-soluble fragrance formulation or (ii) a fragrance formulation comprising hydrophobic fragrance components;

(d) 3–30 parts by weight of a surfactant capable of solubilizing in water hydrophobic fragrance components when (c) is a perfume formulation comprising hydrophobic fragrance components;

(e) 0–5 parts by weight of a silicone resin; and (f) 0–5 parts by weight of a chelating agent; the composition having a diameter of from about 0.9 to about 1.7 centimeters.

3. The process of claim 1 wherein the water-soluble tablet binder is one or more $C_2$–$C_4$ polyalkylene glycols.

4. The process of claim 1 wherein the silicone resin is a polyalkylene oxide modified polydimethyl siloxane.

5. The process of claim 1 wherein the chelating agent is ethylene diamine tetra acetic acid or a water-soluble salt thereof.

6. The process of claim 1 wherein a nonionic surfactant is admixed with a fragrance containing hydrophobic fragrance components and the nonionic surfactant is a $C_{10}$–$C_{18}$ mono- or di-fatty alcohol ether of an ethylene oxide/propylene oxide block copolymer.

7. The process of claim 6 wherein in step (b), the nonionic surfactant is a dilauryl ether of an ethylene oxide/propylene oxide block copolymer and the ratio of ethylene glycol units:propylene glycol units is 9:1.

8. The process of claim 1 wherein in step (b), the fragrance contains hydrophobic fragrance components and the fragrance comprises a composition selected from the group consisting of:

(a) at least one acetal produced by reacting hexyl cinnamic aldehyde with at least one of citronellol, nerol, geraniol, dihydromyrcenol, a phenyl ethyl alcohol and/or tetrahydrolinalool; and (b) at least one hemiacetal produced by reacting hexyl cinnamic aldehyde with at least one of citronellol, nerol, geraniol, dihydromyrcenol, a phenyl ethyl alcohol and/or tetrahydrolinalool.

9. The process of claim 1 wherein the fragrance substance comprises at least one substance selected from the group consisting of:

(a) at least one acetal produced by means of reacting:

(i) the aldehydes: hexylcinnamic aldehyde; p-t-bucinal, heliotropine; a compound having the structure:

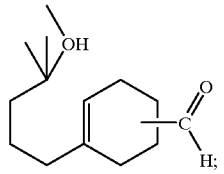

a compound having the structure:

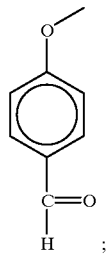

undecylenic aldehyde; and/or dodecanal with (ii) the carbinols: citronellol; nerol; geraniol; dihydromyrcenol; β-phenyl ethyl alcohol; tetrahydrolinalool; a compound having the structure:

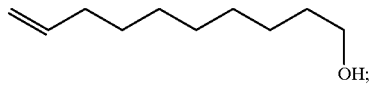

and/or undecavertol; and (b) at least one hemiacetal produced by means of reacting:

(i) the aldehydes: hexylcinnamic aldehyde; p-t-bucinal; heliotropine; a compound having the structure:

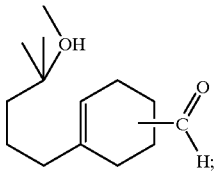

AUBEPINE™ having the structure:

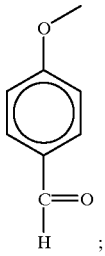

undecylenic aldehyde; and/or dodecanal with (ii) the carbinols: citronellol; nerol; geraniol; dihydromyrcenol; β-phenyl ethyl alcohol; tetrahydrolinalool; a compound having the structure:

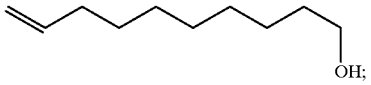

and/or undecavertol.

10. The process of claim 1 wherein the fragrance substance contains the trimer of a compound having the structure:

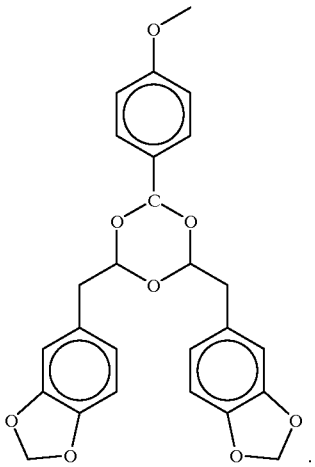

11. The process of claim 1 wherein in the tableting step (d), each of the tablets has a weight of from about 0.75 up to about 2.5 grams and the tableting process is carried out at a pressure of from about 35 psig up to about 60 psig for a time period of from about 30 seconds up to about 60 seconds.

12. The composition of claim 2 wherein the water-soluble tablet binder is one or more $C_2$–$C_4$ polyalkylene glycols.

13. The composition of claim 2 wherein the silicone resin is a polyalkylene oxide modified polydimethyl siloxane.

14. The composition of claim 2 wherein the chelating agent is ethylene diamine tetra acetic acid or a water-soluble salt thereof.

15. The composition of claim 2 wherein a nonionic surfactant is in admixture with a fragrance containing hydrophobic fragrance components and the nonionic surfactant is a $C_{10}$–$C_{18}$ mono- or di-fatty alcohol ether of an ethylene oxide/propylene oxide block copolymer.

16. The composition of claim 15 wherein the nonionic surfactant is the dilauryl ether of an ethylene oxide/propylene oxide block copolymer and the ratio of ethylene glycol units:propylene glycol units is 9:1.

17. The composition of claim 2 wherein the fragrance contains hydrophobic fragrance components and the fragrance comprises a composition selected from the group consisting of:

(a) at least one acetal produced by reacting hexyl cinnamic aldehyde with at least one of citronellol, nerol, geraniol, dihydromyrcenol, a phenyl ethyl alcohol and/or tetrahydrolinalool; and (b) at least one hemiacetal produced by reacting hexyl cinnamic aldehyde with at least one of citronellol, nerol, geraniol, dihydromyrcenol, a phenyl ethyl alcohol and/or tetrahydrolinalool.

18. The composition of claim 2 wherein the fragrance contains at least one substance selected from the group consisting of:

(a) at least one acetal produced by means of reacting:

(i) the aldehydes: hexylcinnamic aldehyde; p-t-bucinal; heliotropine; a compound having the structure:

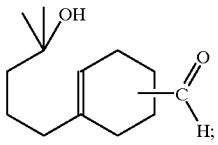

a compound having the structure:

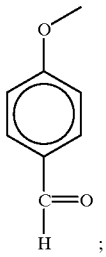

undecylenic aldehyde; and/or dodecanal with (ii) the carbinols: citronellol; nerol; geraniol; dihydromyrcenol; β-phenyl ethyl alcohol; tetrahydrolinalool; a compound having the structure:

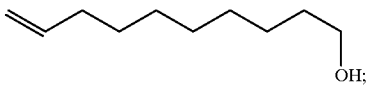

and/or undecavertol; and (b) at least one hemiacetal produced by means of reacting:

(i) the aldehydes: hexylcinnamic aldehyde; p-t-bucinal; heliotropine; a compound having the structure:

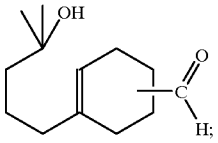

a compound having the structure:

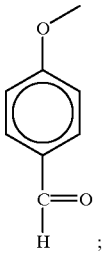

undecylenic aldehyde; and/or dodecanal with (ii) the carbinols: citronellol; nerol; geraniol; dihydromyrcenol; β-phenyl ethyl alcohol; tetrahydrolinalool; a compound having the structure:

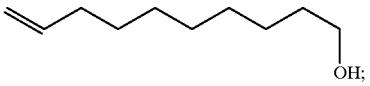

and/or undecavertol.

19. The composition of claim 2 wherein the fragrance contains the trimer of a compound having the structure:

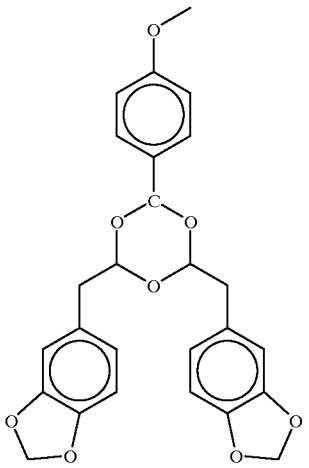

20. A process for producing a tablet for creation of freshening effects comprising the sequential steps of:

(a) admixing (i) 70–90 parts by weight of a solid water-soluble noncorrosive support substance selected from the group consisting of:

(i) one or more ammonium salts of ethylene diamine tetra acetic acid; one or more sodium salts of ethylene diamine tetra acetic acid; or one more potassium salts of ethylene diamine tetra acetic acid;

(ii) one or more ammonium phosphate salts; one or more sodium phosphate salts; one or more potassium phosphate salts; one or more ammonium polyphosphate salts; one or more sodium polyphosphate salts; one or more potassium polyphosphate salts; one or more ammonium pyrophosphate salts; one or more sodium pyrophosphate salts; or one or more potassium pyrophosphate salts;

(iii) one or more ammonium citrate salts; one or more sodium citrate salts; one or more potassium citrate salts; one or more calcium citrate salts or one or more magnesium citrate salts;

(iv) one or more ammonium gluconate salts; one or more sodium gluconate salts; one or more potassium gluconate salts; one or more ammonium oxalate salts; one or more sodium oxalate salts; one or more potassium oxalate salts; one or more ammonium tartarate salts; one or more sodium tartarate salts; one or more potassium tartarate salts; or one or more ammonium succinate salts; one or more sodium succinate salts or one or more potassium succinate salts;

and (v) one or more ammonium $C_1$–$C_4$ alkanoate salts; one or more sodium $C_1$–$C_4$ alkanoate salts or one or more potassium $C_1$–$C_4$ alkanoate salts soluble in water at least over a temperature range of from about 15° C. up to about 50° C. with (ii) 3–6 parts by weight of a water-soluble tablet binder and, optionally (iii) 0.5–5 parts by weight of a silicone resin, optionally (iv) 0.5–5 parts by weight of a chelating agent and optionally (v) a surfactant in order to form a support-binder composition;

(b) either providing a water-soluble fragrance or admixing (i) 3–15 parts by weight of a hydrophobic component-containing fragrance formulation with (ii) 3–30 parts by weight of a surfactant capable of solubilizing in water a fragrance containing hydrophobic fragrance components in order to form a fragrance premix;

(c) blending the fragrance premix with the support-binder composition in order to form a fragranced solid phase powder composition; and (d) tableting the fragranced solid phase powder composition to have a diameter of from about 0.9 to 1.7 cm whereby fragranced tablets are formed.

21. The process of claim 20 wherein the water-soluble tablet binder is one or more $C_2$–$C_4$ polyalkylene glycols.

22. The process of claim 20 wherein the silicone resin is a polyalkylene oxide modified polydimethyl siloxane.

23. The process of claim 20 wherein the chelating agent is ethylene diamine tetra acetic acid or a water-soluble salt thereof.

24. The process of claim 20 wherein a nonionic surfactant is admixed with a fragrance containing hydrophobic fragrance components and the nonionic surfactant is a $C_{10}$–$C_{18}$ mono- or di-fatty alcohol ether of an ethylene oxide/propylene oxide block copolymer.

25. The process of claim 20 wherein in step (b), the nonionic surfactant is a dilauryl ether of an ethylene oxide/propylene oxide block copolymer and the ratio of ethylene glycol units:propylene glycol units is 9:1.

26. The process of claim 20 wherein in step (b), the fragrance contains hydrophobic fragrance components and the fragrance comprises a composition selected from the group consisting of:

(a) at least one acetal produced by reacting hexyl cinnamic aldehyde with at least one of citronellol, nerol, geraniol, dihydromyrcenol, a phenyl ethyl alcohol and/or tetrahydrolinalool; and (b) at least one hemiacetal produced by reacting hexyl cinnamic aldehyde with least one of citronellol, nerol, geraniol, dihydromyrcenol, a phenyl ethyl alcohol and/or tetrahydrolinalool.

27. The process of claim 20 wherein the fragrance substance comprises at least one substance selected from the group consisting of:

(a) at least one acetal produced by means of reacting:

(i) the aldehydes: hexylcinnamic aldehyde; p-t-bucinal; heliotropine; a compound having the structure:

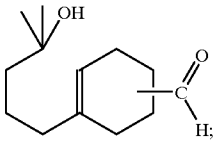

a compound having the structure:

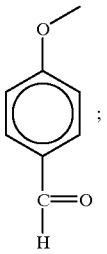

undecylenic aldehyde; and/or dodecanal with (ii) the carbinols: citronellol; nerol; geraniol; dihydromyrcenol; β-phenyl ethyl alcohol; tetrahydrolinalool; a compound having the structure:

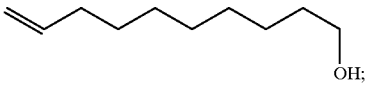

and/or undecavertol; and (b) at least one hemiacetal produced by means of reacting:

(i) the aldehydes: hexylcinnamic aldehyde; p-t-bucinal; heliotropine; a compound having the structure:

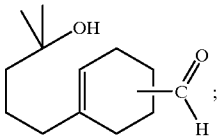

a compound having the structure:

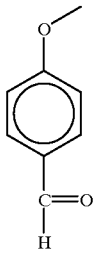

undecylenic aldehyde; and/or dodecanal with (ii) the carbinols: citronellol; nerol; geraniol; dihydromyrcenol; β-phenyl ethyl alcohol; tetrahydrolinalool; a compound having the structure:

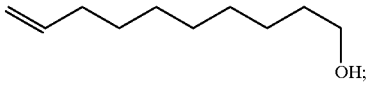

and/or undecavertol.

28. The process of claim 20 wherein the fragrance substance contains the trimer of a compound having the structure:

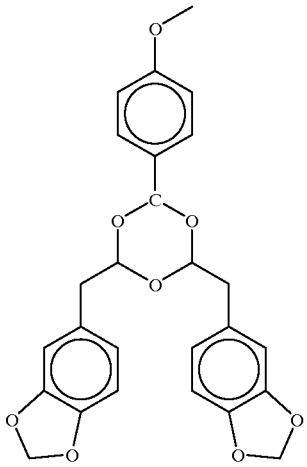

29. The process of claim 20 wherein in the tableting step (d), each of the tablets has a weight of from about 0.75 up to about 2.5 grams and the tableting process is carried out at a pressure of from about 35 psig up to about 60 psig for a time period of from about 30 seconds up to about 60 seconds.

30. A tablet prepared according to the process of claim 20.

* * * * *